US005581518A

United States Patent [19]

Schaefer

[11] Patent Number: 5,581,518

[45] Date of Patent: Dec. 3, 1996

[54] TRANSDUCER COVER

[76] Inventor: Ricky D. Schaefer, 905 12th St. South, Brookings, S. Dak. 57006

[21] Appl. No.: 496,673

[22] Filed: Jun. 29, 1995

[51] Int. Cl.[6] ..... H04R 1/02

[52] U.S. Cl. ..... 367/188

[58] Field of Search ..... 367/188, 166, 367/173, 191, 104

[56] References Cited

U.S. PATENT DOCUMENTS

D. 246,352 11/1977 Dykstra .
D. 248,839 8/1978 Turner .
D. 267,154 12/1982 Bilgutay .
D. 287,829 1/1987 Osaka .
D. 338,869 8/1993 Allbaugh .
4,628,525 12/1986 Iwahara et al. ..... 381/26
4,637,000 1/1987 Thigpen et al. .
5,065,372 11/1991 Garwood et al. .
5,130,954 7/1992 Fussell ..... 367/188
5,155,709 10/1992 Flanagan et al. .
5,169,349 12/1992 Hilbert .

*Primary Examiner*—Daniel T. Pichulic
*Attorney, Agent, or Firm*—Richard C. Litman

[57] ABSTRACT

A protective cover for protecting the sonar transducer of a fishing boat or other recreational watercraft, from damage caused by flying debris during overland towing. The protective cover conforms to the outside shape of the transducer and is secured in place by an elastic strap or a releasable strap using VELCRO® or snap fasteners.

6 Claims, 6 Drawing Sheets

TRANSDUCER COVER

BACKGROUND OF THE INVENTION

1. Field of the Invention

The present invention relates to a protective cover for sonar transducers, more particularly for use with sonar transducers used on fishing boats and other recreational watercraft.

2. Description of the Prior Art

It is common for fishing boats and recreational watercraft to be equipped with sonar for detecting fish and determining the depth of the water. The sonar equipment provided for fishing boats and recreational watercraft generally includes a sonar transducer which is located at the stern of the boat, and hangs below the level of the bottom of the boat's hull. Boats and recreational watercraft often have to be transported overland on trailers towed behind a car or truck. While being transported overland, rocks, gravel, dirt, and other debris thrown up from the towing vehicle tires or the trailer tires, tend to impact upon and damage the sonar transducer.

The transducer emits acoustic waves and receives acoustic waves reflected from the bottom or other objects such as fish present in the water. The emission and reception of acoustic waves generally occurs through the bottom of the transducer. A transducer bottom surface chipped or nicked by rocks, gravel, and other debris, can lead to erroneous information being displayed on the LCD display of the sonar apparatus. For example, non-existent objects or images inconsistent with what is actually present under the water may appear on the display of the sonar apparatus. Also a chipped transducer may fail to detect all the acoustic reflections that it would normally detect. Therefore, the need exists for a protective cover which protects the sonar transducer from impact damage caused by flying debris thrown up by the tires of the towing vehicle and/or trailer. However no protective cover suitable for this particular application is seen in the prior art.

U.S. Pat. No. 4,637,000, issued to Thigpen et al., shows an underwater sonar transducer with an integral depth sensor. The transducer of Thigpen et al. incorporates mechanical filters to protect the depth sensors from damage caused by pressure spikes produced by the acoustic source. Thigpen et al. do not disclose a protective cover for sonar transducers.

U.S. Pat. No. 5,065,372, issued to Garwood et al., shows an electrical circuit component for protecting sonar transducers from damage in the event of underwater explosions. Garwood et al. do not disclose a protective cover for sonar transducers.

U.S. Pat. No. 5,155,709, issued to Flanagan et al., shows an electro-acoustic transducer. Flanagan et al. do not disclose a protective cover for sonar transducers.

U.S. Pat. No. 5,169,349, issued to Hilbert, shows a sonar transducer attached to a trolling motor. Hilbert does not disclose a protective cover for sonar transducers.

U.S. Pat. No. Des. 246,352, issued to Dykstra, shows a probe cover. The cover of Dykstra is not suited for covering the bottom of a sonar transducer.

U.S. Pat. No. Des. 248,839, issued to Turner, shows a thermometer probe end cap. The cap of Turner is not suited for covering the bottom of a sonar transducer.

U.S. Pat. No. Des. 267,154, issued to Bilgutay, shows a probe cover. The cover of Bilgutay is not suited for covering the bottom of a sonar transducer.

U.S. Pat. No. Des. 287,829, issued to Osaka, shows a protective cover for a digital thermometer. The cover of Osaka is not suited for covering the bottom of a sonar transducer.

U.S. Pat. No. Des. 338,869, issued to Allbaugh, shows a cover for a boat motor controller. The cover of Allbaugh does not conform to the shape of a sonar transducer.

None of the above inventions and patents, taken either singly or in combination, is seen to describe the instant invention as claimed.

SUMMARY OF THE INVENTION

The present invention is directed to a protective cover for protecting the sonar transducer of a fishing boat or other recreational watercraft, from damage caused by flying debris during overland towing. The protective cover conforms to the outside shape of the transducer and is secured in place by an elastic strap or a releasable strap using VELCRO® or snap fasteners.

Accordingly, it is a principal object of the invention to provide a cover that protects sonar transducers from flying debris during overland transportation.

It is another object of the invention to provide a protective cover for sonar transducers that is made of a rigid material.

It is a further object of the invention to provide a protective cover for sonar transducers that is made of a flexible material.

Still another object of the invention is to provide a protective cover for sonar transducers that fits a variety of transducer shapes and sizes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
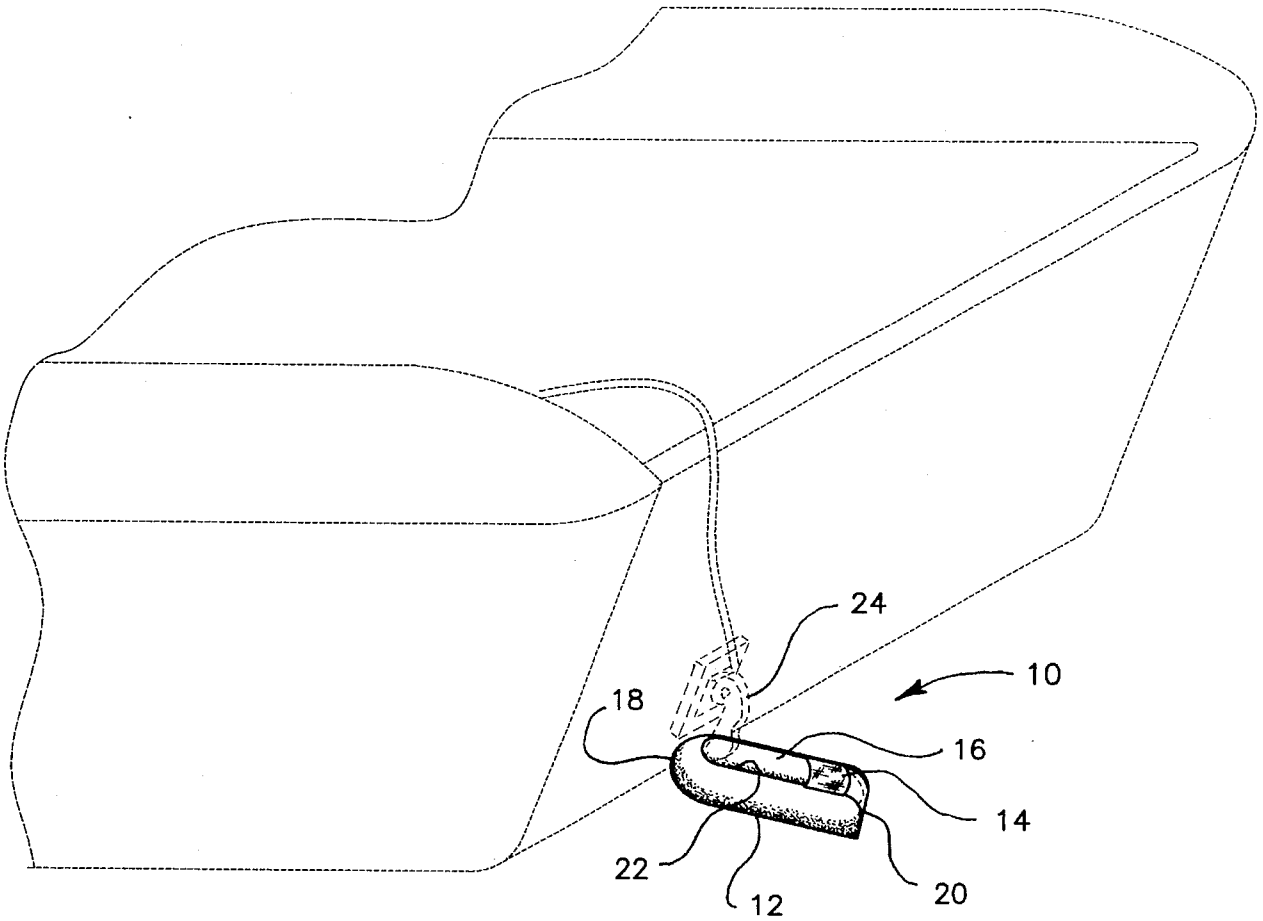
FIG. 1 is an environmental perspective view showing the protective cover of the present invention applied to a sonar transducer mounted at the stern of a boat.

Referring to FIGS. 1–6 the present invention is a transducer cover 10 including a cover portion 12 and a retaining strap 14. The cover portion 12 is shaped to conform snugly to the exterior shape of the transducer 16. In other words, the cover portion 12 is shaped to follow the contour of the exterior of the transducer 16. The transducer 16 is typically oblong, is streamlined, and has an oval cross section. The cover portion 12 has a closed end 18 and an open end 20. Cover 10 is slipped on transducer 16 through the open end 20. U-shaped slot 22 accommodates supporting stem 24. The stem 24 extends from the top of transducer 16, in a generally vertical direction and is perpendicular to the longitudinal axis of transducer 16. U-shaped slot 22 has an open end 26 and a closed end 28. The open end 26 of slot 22 is formed by the intersection of slot 22 and the open end 20 of the cover portion 12. U-shaped slot 22 extends from open end 20 for a distance sufficient to allow the closed end 18 of the cover portion to matingly envelop the front end of the transducer 16, without the stem 24 interfering with the movement of the cover portion 12. Preferably, the stem 24 will be at the rounded, closed end 28 of the slot 22, when the cover portion 12 matingly envelops the front end of transducer 16. A retaining strap 14 extends between the sides of the U-shaped slot 22 proximate the open end 26 to thereby retain the transducer cover 10 in place.

Figure 2:
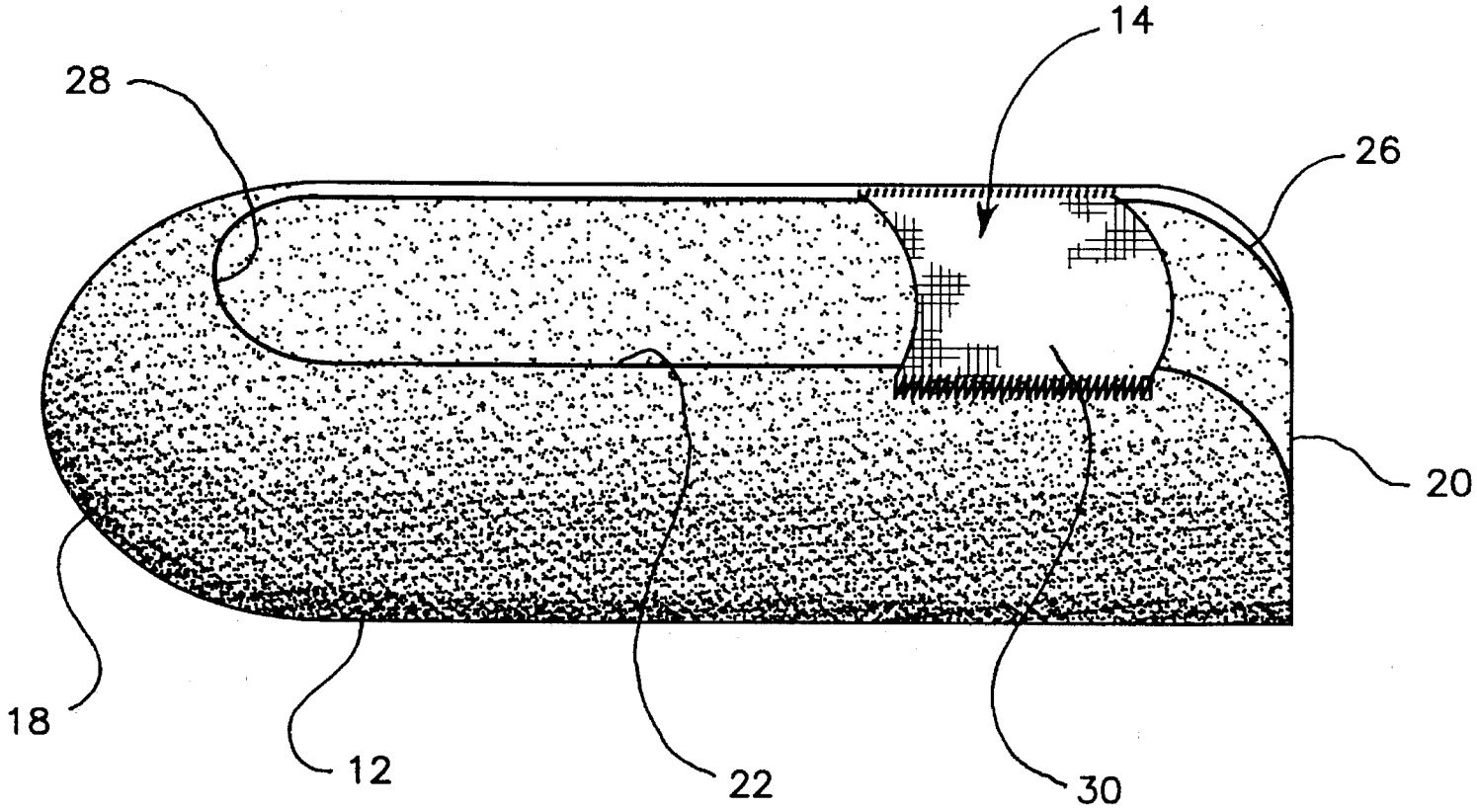
FIG. 2 is a perspective view showing the first embodiment of the protective cover of the present invention which uses an elastic strap.

Referring to FIG. 2 the first embodiment of the protective cover of the present invention is seen. The embodiment of FIG. 2 uses a one piece elastic strap 30 which has its ends permanently attached to respective sides of U-shaped slot 22, proximate the open end 26. The elastic 30 is sufficiently stretchable to allow the strap to pass around the side of the cover portion 12 opposite to the side having slot 22 therein. After the cover is slipped on the transducer, elastic 30 is stretched and moved around the open end 20 of cover portion 12 and allowed to snap into a position stretching between opposite sides of U-shaped slot 22, proximate the open end 26. Thus the elastic 30 retains cover 10 in place by impeding movement of stem 24 out of the slot 22.

Figure 3:
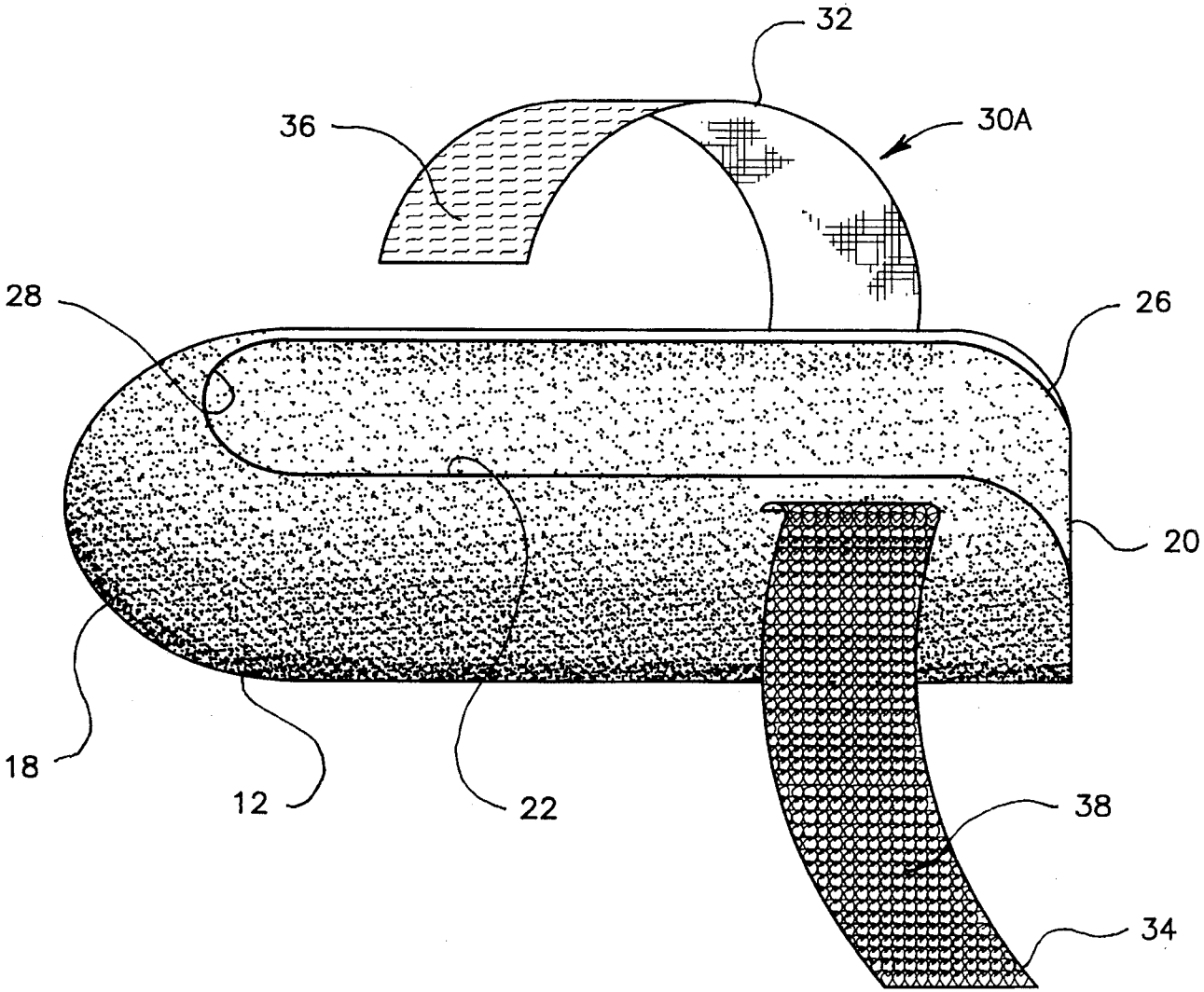
FIG. 3 is a perspective view showing the second embodiment of the protective cover of the present invention which uses a two piece VELCRO® strap.

Referring to FIG. 3 the second embodiment of the protective cover of the present invention is seen. The embodiment of FIG. 3 uses a two piece strap 30A. Each piece of strap 30A has one of its ends permanently attached to a respective side of U-shaped slot 22, proximate the open end 26. The free end of a first piece 32 of strap 30A is provided with the hook portion 36 of a hook-and-loop fastening system of the VELCRO® type. The free end of a second piece 34 of strap 30A is provided with the loop portion 38 of a hook-and-loop fastening system of the VELCRO® type. Portions 36 and 38 extend along the surfaces of the first piece 32 of strap 30A and the second piece 34 of strap 30A, respectively, for some distance to allow for adjustment of the length of strap 30A when the portions 36 and 38 are fastened together.

In use, the two pieces of strap 30A are pulled apart and then the cover is slipped on the transducer through the open end 20. After the cover 10 is slipped on the transducer, the two pieces of strap 30A are fastened together, using the hook-and-loop fastening system, to retain the cover 10 in place by impeding movement of stem 24 out of the slot 22. The strap 30A is preferably made of a nylon web or strips of elastic material.

Figure 4:
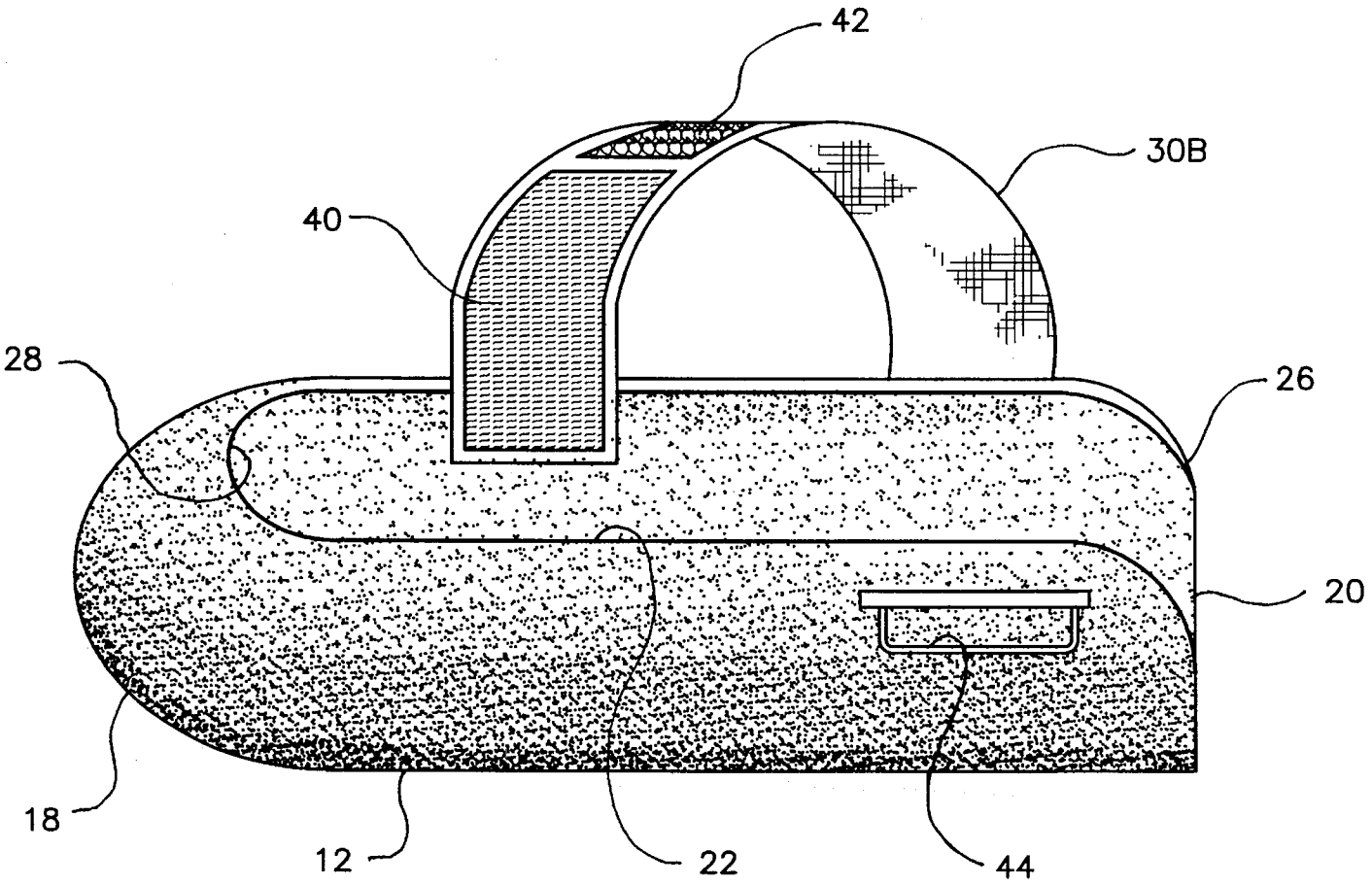
FIG. 4 is a perspective view showing the third embodiment of the protective cover of the present invention which uses a one piece VELCRO® strap.

Referring to FIG. 4 the third embodiment of the protective cover of the present invention is seen. The embodiment of FIG. 4 uses a one piece strap 30B. The strap 30B has one of its ends permanently attached to one side of the U-shaped slot 22, proximate the open end 26.

The free end of the strap 30B is provided with the hook or loop portion 40 of a hook-and-loop fastening system of the VELCRO® type, on the side of the strap facing away from the slot 22. Extending over a medial portion of strap 30B is the portion 42 of the hook-and-loop fastening system complementing the portion 40 at the free end of strap 30B. If the portion 40 is of the hook type material, then the portion 42 is of the loop type material. If the portion 40 is of the loop type material, then the portion 42 is of the hook type material. Portions 40 and 42 are on the same side of the strap 30B.

A oval eyelet 44 is provided on the side of the slot 22 opposite the side to which strap 30B is attached. The length of the eyelet 44 is sufficiently long to allow strap 30B to pass therethrough unhindered. In use, the strap 30B is passed through eyelet 44 after the cover 10 is slipped on the transducer through the open end 20. The strap 30B is then drawn tightly through eyelet 44 and folded back on itself to allow portions 40 and 42 to be fastened together. Once portions 40 and 42 are fastened together, the cover 10 will be retained in place because strap 30B will impede movement of stem 24 out of the slot 22. The strap 30B is preferably made of a nylon web or a strip of elastic material.

Figure 5:
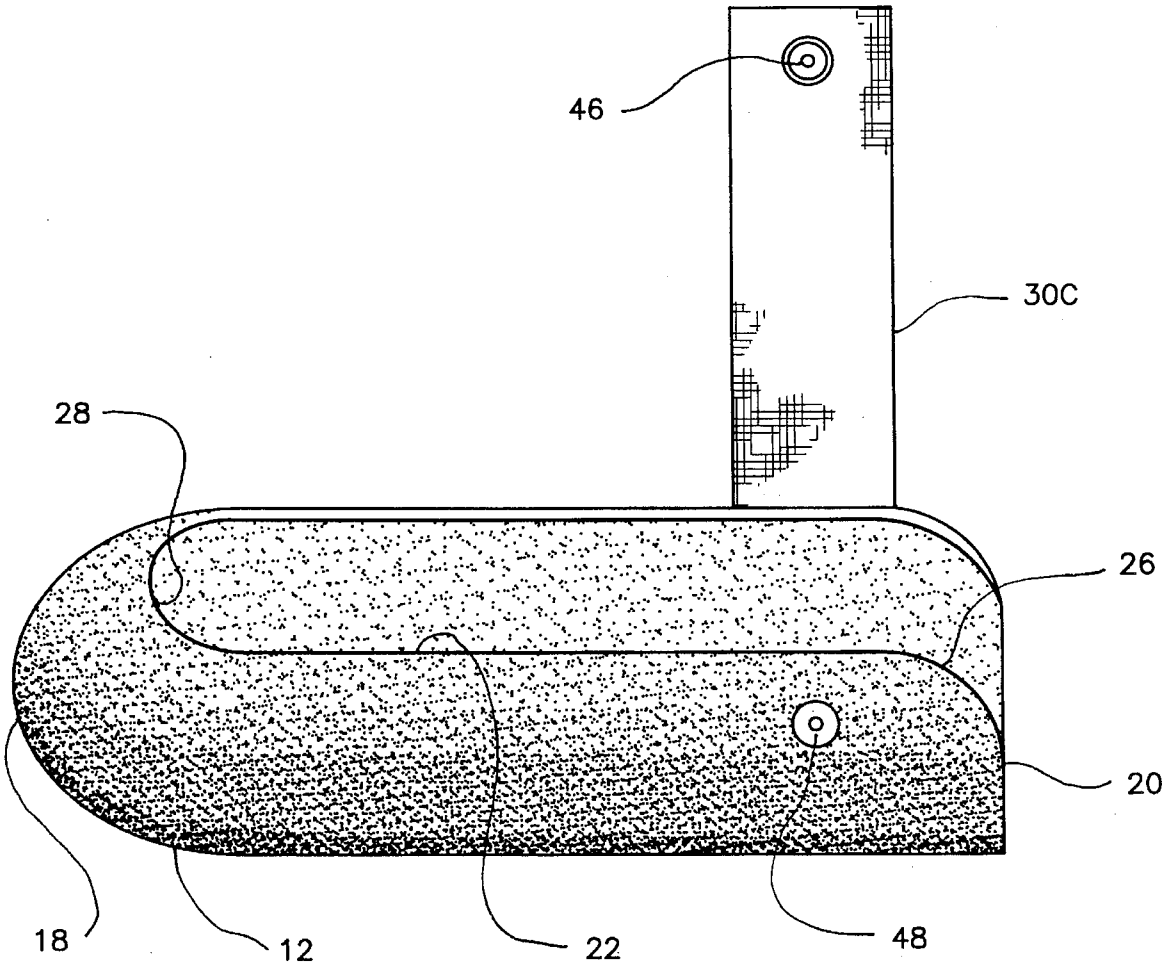
FIG. 5 is a perspective view showing the fourth embodiment of the protective cover of the present invention which uses a strap having a snap fastener.

Referring to FIG. 5 the fourth embodiment of the protective cover of the present invention is seen. The embodiment of FIG. 5 uses a one piece strap 30C. The strap 30C has one of its ends permanently attached to one side of the U-shaped slot 22, proximate the open end 26.

The free end of the strap 30C is provided with the male or female portion 46 of a snap fastener. The portion 48 of the snap fastener complimentary to portion 46, is provided on the side of the slot 22 opposite the side to which strap 30C is attached. If the portion 46 is female, then the portion 48 is male. If the portion 46 is male, then the portion 48 is female. The strap 30C is preferably made of an elastic material and is of a length such that it has to be stretched for portions 46 and 48 to be fastened together, when cover 10 is slipped on the transducer.

In use, the cover 10 is slipped on the transducer 16, and then strap 30C is stretched until portion 46 reaches portion 48 of the snap fastener. Portions 46 and 48 are then fastened together to retain the cover 10 in place by impeding movement of stem 24 out of the slot 22.

Figure 6:
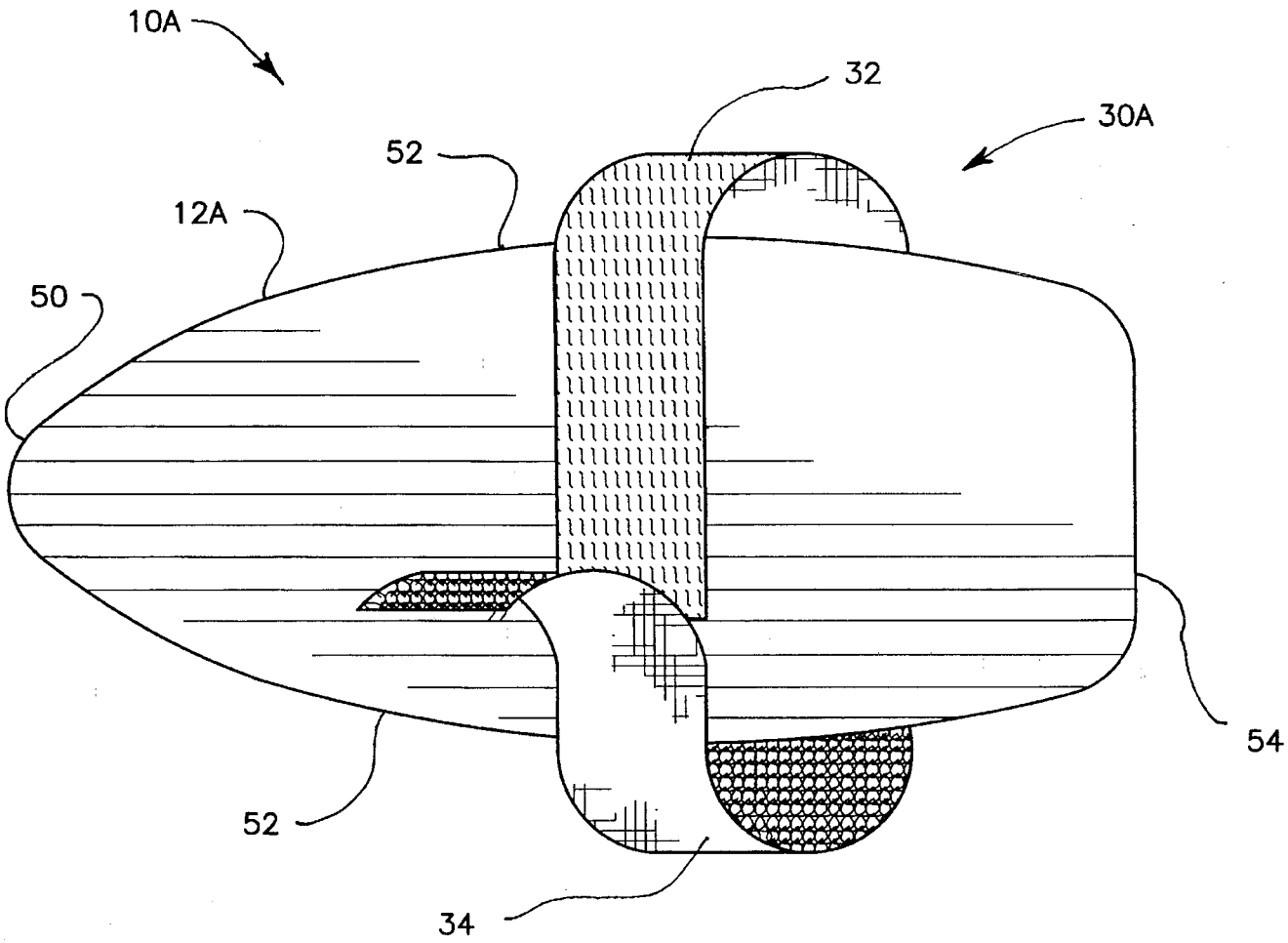
FIG. 6 is a perspective view showing the fifth embodiment of the protective cover of the present invention which includes a flat protective fabric and a two piece VELCRO® strap.

Referring to FIG. 6 the fifth embodiment of the protective cover of the present invention is seen. The embodiment of FIG. 6 uses a two piece strap 30A which is identical to the strap 30A of the embodiment of FIG. 3. Each piece of strap 30A has one of its ends permanently attached to a respective lateral edge of cover 10A. Cover 10A differs from cover 10 in that it is intended to be universally applicable regardless of the shape of the particular transducer to which it is being applied. Cover portion 12A of cover 10A is in the form of a flat sheet of flexible material such as leather, NAUGAHYDE™, CORDURA™, canvas and the like. In plan view, cover portion 12A of cover 10A has a rounded or tapering front portion 50, and lateral edges 52 extending from the front portion to a rear edge 54. Rear edge 54 extends substantially perpendicularly between lateral edges 52. As was noted above first and second pieces 32 and 34 of strap 30A are attached to lateral edges 52.

In use, cover 10A is positioned flat against the bottom of the transducer 16. Then the lateral edges 52 are wrapped around respective sides of transducer 16, and pieces 32 and 34 are fastened together to retain the cover 10A on transducer 16 by a tight friction fit.

Cover portion 12 can be made from any suitable material including leather, NAUGAHYDE™, CORDURA™, canvas, plastic, plexiglass, and aluminum. NAUGAHYDE™ is a trade name for a commonly used vinyl covered fabric that simulates leather. CORDURA™ is a trade name for a tough fabric made of nylon webbing.

It is to be understood that the present invention is not limited to the embodiments described above, but encompasses any and all embodiments within the scope of the following claims.

I claim:

1. A protective cover for a sonar transducer, the sonar transducer having a stem extending therefrom and the sonar transducer having an oblong streamlined shape, the stem being capable of supporting the sonar transducer when the sonar transducer is attached to a boat, said protective cover comprising:

a cover portion being in the form of a receptacle having an open rear end for allowing the sonar transducer to be received within said cover portion and said receptacle having a closed front end, said cover portion further having a U-shaped slot extending from said open rear end in a direction toward said closed front end, said U-shaped slot intersecting said open rear end to form an open slot end, said U-shaped slot further having a closed slot end, a first lateral side extending between said open slot end and said closed slot end, and a second lateral side extending between said open slot end and said closed slot end, said second lateral side being spaced from and parallel to said first lateral side, said U-shaped slot accommodating the stem when the sonar transducer is received within said cover portion, and said cover portion being shaped to conform to the oblong, streamlined shape of the sonar transducer; and a strap extending between said first lateral side of said U-shaped slot and said second lateral side of said U-shaped slot for securing said protective cover to the sonar transducer.

2. The protective cover according to claim 1, wherein said strap is a one piece elastic strip having first and second ends, said first end of said elastic strip being fixed to said first lateral side of said U-shaped slot and said second end of said elastic strip being fixed to said second lateral side of said U-shaped slot.

3. The protective cover according to claim 1, wherein said strap includes:

a first piece having first and second ends, said first end of said first piece being fixed to said first lateral side of said U-shaped slot;

a second piece having first and second ends, said first end of said second piece being fixed to said second lateral side of said U-shaped slot; and a hook-and-loop fastener having first and second portions, said first portion of said hook-and-loop fastener being provided on a portion of said first piece, and said second portion of said hook-and-loop fastener being provided on a portion of said second piece, whereby said protective cover is secured to the sonar transducer when said first portion of said hook-and-loop fastener engages said second portion of said hook-and-loop fastener.

4. The protective cover according to claim 1, wherein said cover portion includes an eyelet provided adjacent said first lateral side of said U-shaped slot, and said strap is in one piece, has a first end, and a second end, said first end of said strap being fixed to said second lateral side of said U-shaped slot, said strap having a first portion of a hook-and-loop fastener provided proximate said second end thereof, and said strap having a second portion of said hook-and-loop fastener provided intermediate said first end of said strap and said first portion of said hook-and-loop fastener, whereby passing said second end of said strap through said eyelet and fastening said first portion of said hook-and-loop fastener to said second portion of said hook-and-loop fastener can secure said protective cover to the sonar transducer.

5. The protective cover according to claim 1, wherein said cover portion includes a first portion of a snap fastener provided adjacent said first lateral side of said U-shaped slot, and said strap is in one piece, has a first end, and a second end, said first end of said strap being fixed to said second lateral side of said U-shaped slot, said strap having a second portion of said snap fastener proximate said second end thereof, and said second portion of said snap fastener being matingly engageable with said first portion of said snap fastener, whereby engaging said second portion of said snap fastener with said first portion of said snap fastener can secure said protective cover to the sonar transducer.

6. A protective cover for a sonar transducer, the sonar transducer having a stem extending therefrom and the sonar transducer having an oblong streamlined shape, the stem being capable of supporting the sonar transducer when the sonar transducer is attached to a boat, said protective cover comprising:

a cover portion being in the form of a flat piece of material having a tapering front end, first and second lateral edges extending from said front end to a rear edge, said rear edge extending substantially perpendicularly between said first and second lateral edges; and a strap for securing said protective cover to the sonar transducer, said strap including, a first piece having first and second ends, said first end of said first piece being fixed to said first lateral edge, a second piece having first and second ends, said first end of said second piece being fixed to said second lateral edge, and a hook-and-loop fastener having first and second portions, said first portion of said hook-and-loop fastener being provided on a portion of said first piece, and said second portion of said hook-and-loop fastener being provided on a portion of said second piece, whereby said protective cover can be secured to the sonar transducer when said first portion of said hook-and-loop fastener engages said second portion of said hook-and-loop fastener.

* * * * *